United States Patent [19]

Shirai

[11] Patent Number: 4,856,232

[45] Date of Patent: Aug. 15, 1989

[54] WORKPIECE CARRIER MEANS FOR SURFACE GRINDING MACHINE

[75] Inventor: Hikaru Shirai, Itami, Japan

[73] Assignee: Daisyo Seiki Kabushiki Kaisha, Osaka, Japan

[21] Appl. No.: 83,999

[22] Filed: Aug. 11, 1987

[30] Foreign Application Priority Data

May 7, 1987 [JP] Japan ..... 62-111590

[51] Int. Cl.[4] ..... B24B 47/02

[52] U.S. Cl. ..... 51/215 AR; 51/215 R; 51/215 CP; 51/215 UE; 51/118

[58] Field of Search ..... 51/111 R, 115, 118, 51/133, 215 R, 215 AR, 215 CP, 215 UE, 235

[56] References Cited

U.S. PATENT DOCUMENTS

| | | | |
|---|---|---|---|
| 1,509,823 | 9/1924 | Blood | 51/111 R |
| 1,528,993 | 3/1925 | Samuel | 51/115 |
| 2,740,237 | 4/1956 | Day | 51/133 |
| 3,142,137 | 7/1964 | Fallon | 51/111 R |
| 3,425,169 | 2/1969 | Dunn | 51/118 |
| 3,812,624 | 5/1974 | Dunn | 51/115 |
| 3,818,640 | 6/1974 | Dunn | 51/118 |

FOREIGN PATENT DOCUMENTS

| | | | |
|---|---|---|---|
| 118447 | 6/1985 | Japan | 51/215 AR |
| 889513 | 2/1962 | United Kingdom | 51/115 |

*Primary Examiner*—Frederick R. Schmidt
*Assistant Examiner*—Blynn Shideler
*Attorney, Agent, or Firm*—Armstrong, Nikaido, Marmelstein, Kubovcik & Murray

[57] ABSTRACT

A workpiece carrier means for a surface grinding machine providing in a rockable carrier arm a revolving workpiece holder which holds plural workpieces, feeding the plural workpieces in between grinding wheels while simultaneously revolving them, providing an automatic limited revolution mechanism, the plural workpieces being simultaneously loaded on and unloaded from the revolving workpiece holder by means of a loading arm and an unloading arm having workpiece adsorption members; thereby accomplishing as fine finishing accuracy and an improved work efficiency at the same time.

4 Claims, 5 Drawing Sheets

III
01
7
1
left
2
14
6
13
11
5
VII
VII
17
10
front
18
II 10
2
2
1

WORKPIECE CARRIER MEANS FOR SURFACE GRINDING MACHINE

BACKGROUND OF THE INVENTION 1. (Industrial useful field)

This invention relates to a workpiece carrier means for a surface grinding machine which grinds a workpiece in between a pair of grinding wheels.

2. (Prior art)

Conventionally, in case of grinding many workpieces; for example, a so-called passing-through type carrier disc or a carrier belt always moving in a fixed direction has been installed, the workpieces have been consecutively loaded on the carrier means in turn to be fed to between grinding wheels in such a manner as passing through in a fixed direction, thus the grinding process has been completed while they have passed through and between the grinding wheels.

However, the workpiece itself can not be revolved during the grinding process in the foregoing passing-through type carrier means, so that it is hard to improve a finishing accuracy and moveover it is impossible to finish a ground surface more accurately by means of a cut-in motion of grinding wheel during grinding, i.e. by narrowing a distance between the grinding wheels during grinding.

As a countermeasure against the above trouble, there has been proposed a surface grinding machine disclosed in Patent Application (Kokai) No. 57-26905, in which a workpiece is loaded on a reciprocating plate and this plate is reciprocated through between grinding wheels while the workpiece is revolved, thus the grinding process being accomplished. In this method, however, the carrier means becomes too large and moreover only one workpiece can be ground during the grinding process.

3. (Object of the invention)

An object of the invention is to provide a workpiece carrier means, in which plural workpieces can be ground at a time while being revolved, a finishing accuracy can be improved further as compared with the passing-through type carrier means, and moreover plural workpieces can be loaded on a workpiece carrier in places simultaneously and securely.

In order to accomplish the above object, in this invetion; a revolving workpiece holder having plural workpiece pockets is revolvably installed at a tip end of a carrier arm, the carrier arm being equipped in a rockable manner within a range from a grinding position between grinding wheels to a setting position apart from the grinding wheels; an automatic limited revolution mechanism which stops a revolution of the workpiece holder at a specified angular spot in the setting position of said carrier arm, is equipped; a loading arm and an unloading arm which have plural workpiece suction members in an arrangement corresponding to a workpiece pocket arrangement at the specified angular spot, are equipped in a rockable manner; and plural workpieces are simultaneously loaded on and unloaded from the workpiece holder in the above setting position by means of the loading arm and the unloading arm.

DETAILED DESCRIPTION OF THE INVENTION (Embodiment 1)

Figure 1:
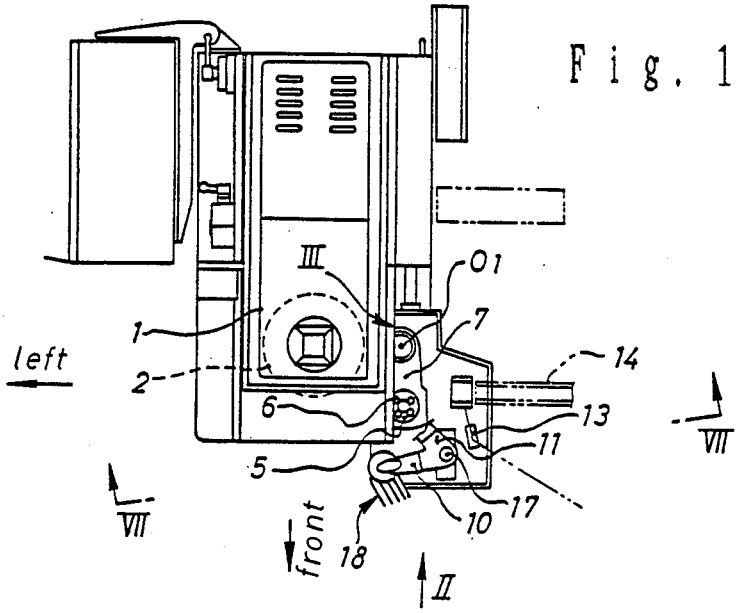
FIG. 1 is a plan view of a surface grinding machine according to the invention.

FIG. 1 shows the plan view of the surface grinding machine according to the present invention, in which a pair of upper and lower grinding wheels 2 are rotatably disposed in a grinding wheel guard 1.

A carrier arm 7 is disposed at a right side of the grinding wheel 2, and the carrier arm 7 is rockable around a rocking fulcrum 01 within a range from a setting position apart from the grinding wheels 2 as illustrated by solid lines, to a grinding position where the arm is inserted between the grinding wheels 2.

A measuring device 13 measuring a grinding thickness of a workpiece after grinding and a discharging shute 14 are disposed in turn at a right side of the carrier arm 7. A workpiece loading arm 10 and an unloading arm 11 are disposed in front of the carrier arm 7, and both the above arms 10 & 11 are formed integrally into a V-shape and fastened to a vertical rocking shaft 17 to be permitted a rocking motion. The loading arm 10 rocks (reciprocally) between a charging device 18 and a workpiece holder 5 at the tip end of the carrier arm 7, and the unloading arm 11 rocks (reciprocally) between said workpiece holder 5 and the measuring device 13.

Figure 2:
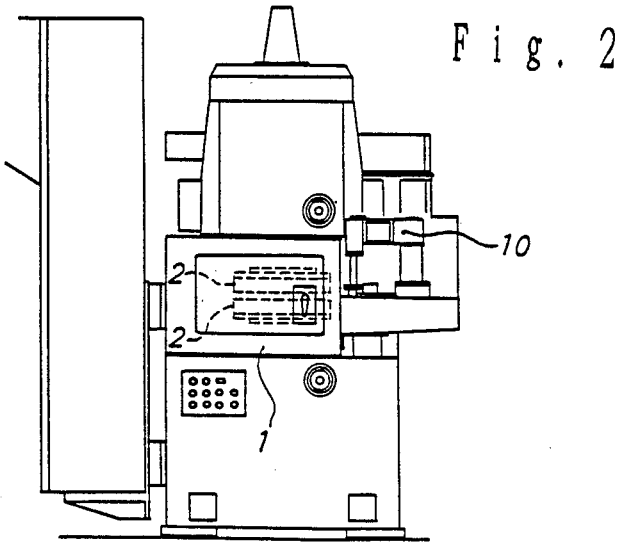
FIG. 2 is a (front) view viewed in a direction of arrow II of FIG. 1.

In FIG. 2, the upper and the lower grinding wheels 2 & 2 are so fabricated that they can move nearer to or apart from each other during grinding, thereby a so-called cut-in grinding caused by narrowing a distance between the grinding wheels 2 becomes possible.

Figure 5:
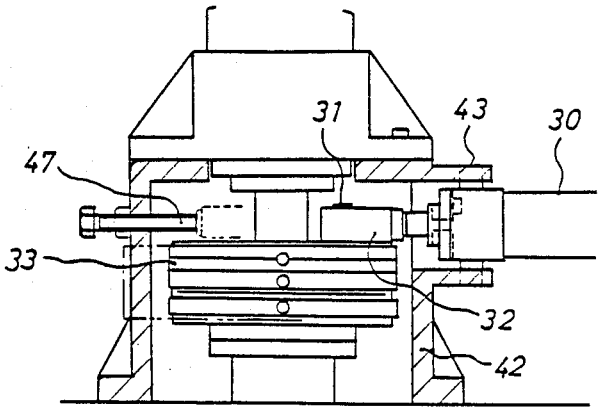
FIG. 5 is a view of a part V' of FIG. 3 viewed in a direction of arrow V.
Figure 6:
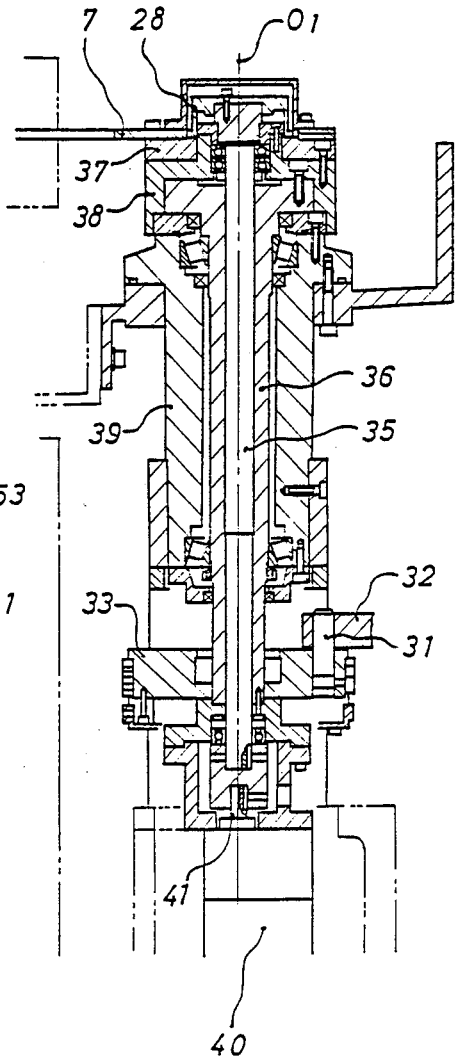
FIG. 6 is a sectional view taken on a line VI—VI of FIG. 3.

With reference to FIG. 6, a mechanism for rocking the carrier arm 7 around the rocking fulcrum 01 will be described hereunder. The carrier arm 7 is fastened to a rocking cylindrical shaft 36 through intermediate members 37 & 38, and the cylindrical shaft 36 is carried rotatably by a bearing case member 39 through bearings. A turning plate 33 is fastened to a lower end of the cylindrical shaft 36, an eccentric pin 31 is fixed to the turning plate 33 at a position apart from the rocking fulcrum 01, and the tip end portion of a rod 32 of an air cylinder 30 is pinned rotatably to said eccentric pin 31 as illustrated by FIG. 5. The air cylinder 30 is supported rotatably by a vertical pin 43 to a base 42. 47 is a stopper bolt which limits the maximum stroke of the rod 32. Namely, one stroke cycle (reciprocation) of the rod 31 of the air cylinder 30 causes the carrier arm 7 at the setting position of FIG. 3 to turn in a direction of arrow F up to a grinding position between the grinding wheels as illustrated by imaginary lines, and further causes it to return to the setting position in a direction of arrow B again.

Figure 3:
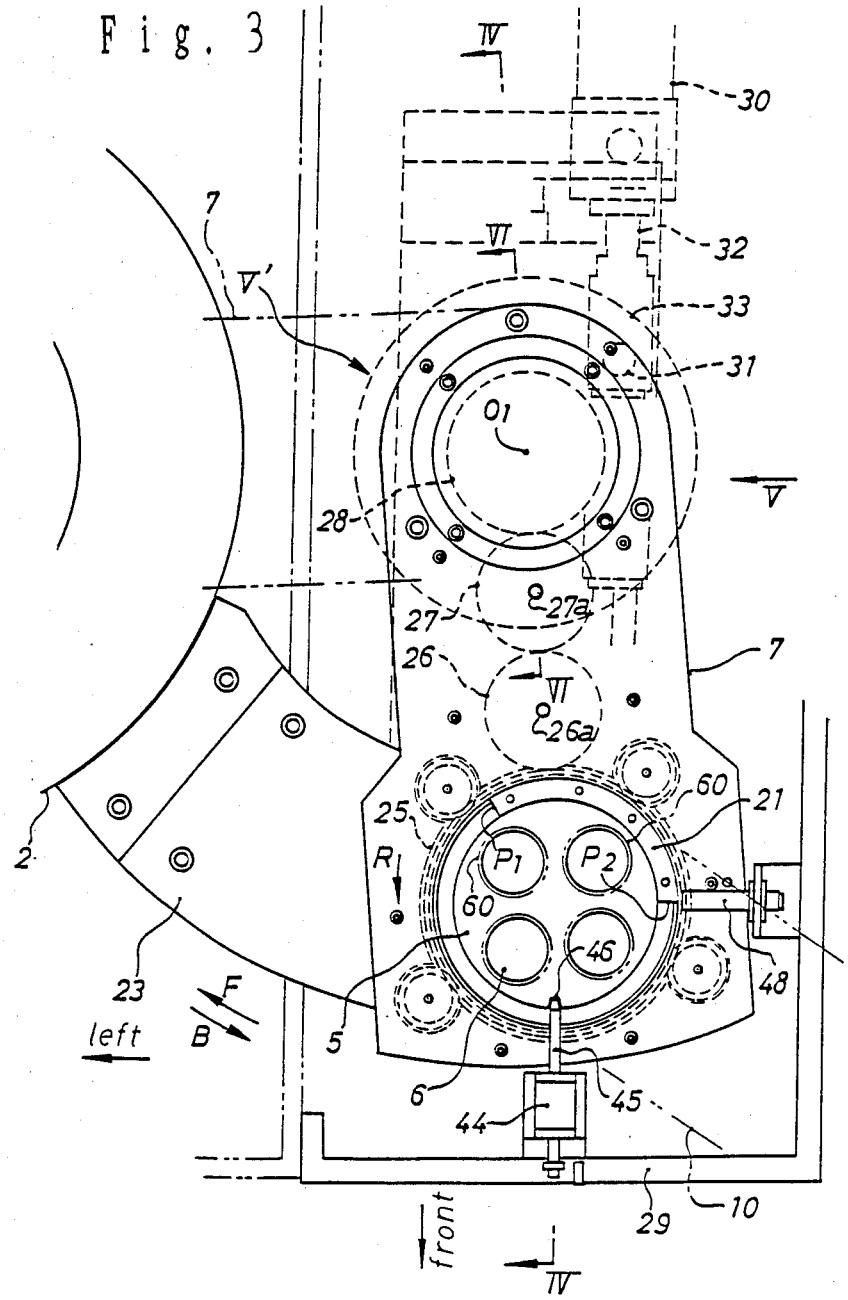
FIG. 3 is an enlarged plan view of a part III of FIG. 1.

In FIG. 3, the workpiece holder 5 is formed into a disc-like shape and at the same time installed revolvably at a front end portion of the carrier arm 7, and plural, i.e. four for instance, workpiece pockets 6 for holding the workpieces are formed on the workpiece holder 5. The workpiece pockets 6 are through holes formed into circular shapes and disposed, for example, on the same circle with equal distances left therebetween. The workpiece holder 5 is disposed on an inner periphery of a ring gear 25 within the carrier arm 7 and fastened, in a detachable manner, by bolts etc. to the ring gear 25 together with a circular holding member 21 on the workpiece holder 5. 23 is a guide stand having a horizontal top guide surface and extends in a circular arc manner from a position corresponding to the workpiece holder 5 at its setting position along a rocking locus of the workpiece carrier to a position near to the grinding wheel 2, and a workpiece inserted in the workpiece holder 5 moves on the top surface of the guide stand 23 while sliding on the top surface of the guide stand 23.

A mechanism for revolving the workpiece holder 5 will be described hereunder. The ring gear 25 meshes with a drive gear 28 through two intermediate gears 26 & 27. 26*a* & 27*a* are shafts for the intermediate gears 26 & 27.

Figure 4:
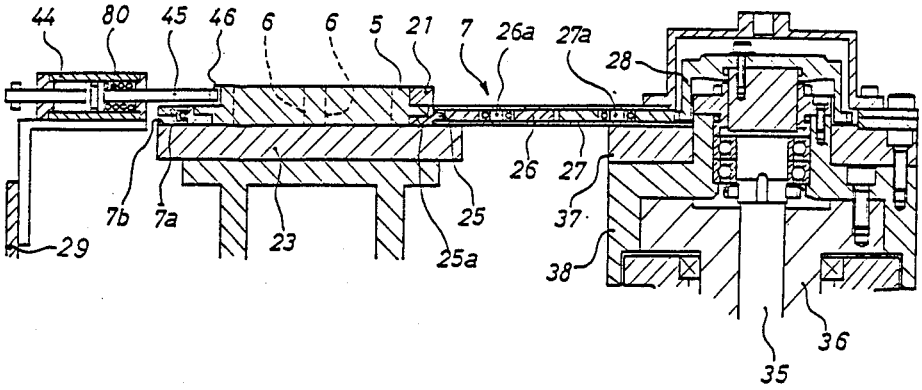
FIG. 4 is an upper side view taken on a line IV—IV of FIG. 3.

In FIG. 4 showing the vertical sectional view taken on the line IV—IV of FIG. 3, the carrier arm 7 is composed of two, upper and lower, members 7*a* & 7*b* connected together and includes a gear housing space between the upper and lower members 7*a* & 7*b*, thus rotatably housing the intermediate gears 26 & 27 etc. in said space. The ring gear 25 has an annular stepped part 25*a*, and said workpiece holder 5 is mounted on the stepped part 25*a* and fastened together with the holding member 21 as mentioned above. The drive gear 28 is fastened to the rotating shaft 35, the rotating shaft 35 is rotatably carried in said cylindrical shaft 36 through the bearing as illustrated by FIG. 6, and a lower end portion of the rotating shaft 35 is coupled to an output shaft 41 of a geared motor 40. The geared motor 40 is adapted to change its speed and stop its motion freely. Namely, a rotation of the geared motor 40 causes the workpiece holder 5 to turn in a direction of arrow R through the rotating shaft 35, the drive gear 28 of FIG. 3, the intermediate gears 27 & 26 and the ring gear 25.

Next, a mechanism for stopping the workpiece holder 5 at a specified position when the carrier arm 7 returns to the setting position, will be described hereunder. As illustrated in FIG. 3, an air cylinder 44 is held to a frame 29 through a bracket at a forward side of the carrier arm 7, and the air cylinder 44 has a stopper rod 45 which can be freely pushed to and pulled from a direction of a center of the workpiece holder 5. On the other hand, a notch 46 is made on an outer peripheral surface of the workpiece holder 5 so that the workpiece holder 5 can be stopped at the specifified position as shown in FIG. 3 by making the stopper rod 45 engage with the notch 46.

Further, compressed air in the air cylinder 44 is discharged at a stage before the carrier arm 7 moves in the direction of arrow F, so that the stopper rod 45 is withdrawn by a function of a spring 80 in the air cylinder 44.

Moreover, a proximity switch 48 facing on the holding member 21 from radial outside is disposed at a right side of the workpiece holder 5, held to the frame 29 through a bracket, and at the same time connected to an appropriate control mechanism. When a rotation directional commencing part P1 of the holding member 21 passes the proximity switch 48, a deceleration command is given to the geared motor 40 of FIG. 6 to cause a deceleration of the workpiece holder 5 of FIG. 3. A signal for letting the rod 45 project is given to the air cylinder 44 during turning, i.e. while the holding member 21 passes the proximity switch 48. When an ending part P2 of the holding member 21 comes to face on the proximity switch 48 while keeping decelerated state as illustrated by FIG. 3, a stopping command is given to the geared motor 40 of FIG. 6. Furthermore, the notch 46 is so disposed as to come to a position corresponding to the rod 45 when the ending part P2 of the holding member 21 passes the proximity switch 48 as described above.

Figure 7:
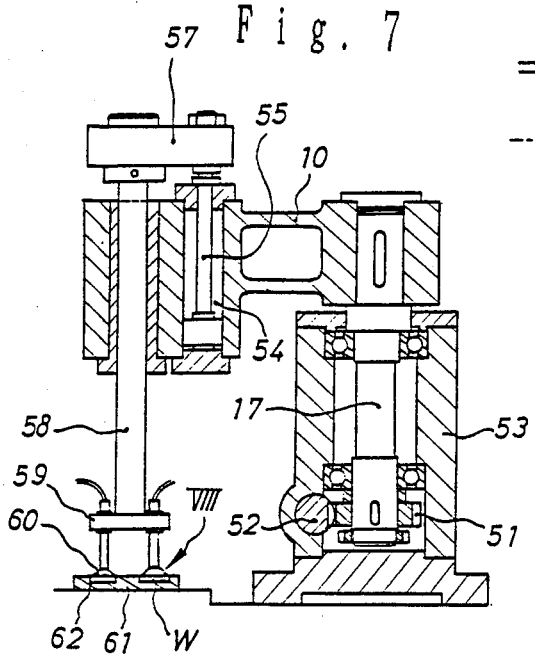
FIG. 7 is an enlarged sectional view taken on a line VII—VII of FIG. 3.

FIG. 7 shows the enlarged vertical sectional view of the loading arm 10, the rocking shaft 17 is rotatably carried by a bearing case 53 through bearings and has a drive gear 51 integrally at its lower end portion, and the drive gear 51 meshes with a drive rack 52. Namely, a reciprocating rotational motion of the drive rack 52 causes the loading arm 10 to rock through means of the gear 51 and the rocking shaft 17. An air cylinder 54 having a vertically moving rod 55 is provided at the tip end portion of the loading arm 10, and an elevating rod 58 is connected through a connector 57 to an upper end of the rod 55. The elevating rod 58 is supported in a vertically movable manner at the tip end portion of the loading arm 10 and extends downward, a pad holder 59 is installed integrally at its bottom end, and four downward air suction type adsorption pads 60 are equipped to the pad holder 59. The adsroption pads 60 are connected to an air suction unit in such a way that they can be switched between suction and nonsuction modes at will. The four adsorption pads 60 are disposed at positions corresponding to the positions of the pockets 6 of the workpiece holder 5 in its rest state when the loading arm 10 comes on the workpiece holder 5 as illustrated by the imaginary lines of FIG. 3.

Figure 8:
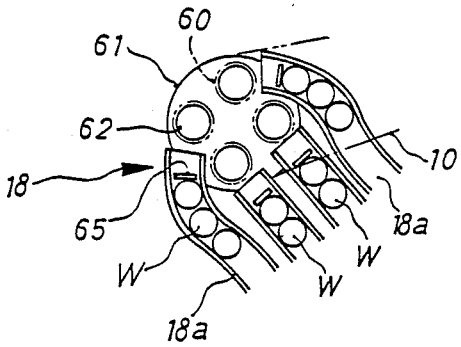
FIG. 8 is an enlarged top view of a part VIII of FIG. 7.

On the other hand, the loading device 18 is equipped with a workpiece distribution holder 61 having four pocket recessions 62 as illustrated by FIG. 8. The pocket recessions are disposed at positions corresponding to those of the four adsorption pads 60 when the loading arm 10 comes on said distribution holder 61. Further, workpiece charging shutes 18*a* front on the pocket recessions 62 respectively, so that workpieces W can be charged respectively and simultaneously by opening/closing of automatic stopper mechanism 65 on every reciprocation of the loading arm 10.

Although not specifically illustrated, the unloading arm 11 of FIG. 1 has the similar construction, too. It has four air suction type adsorption pads which can be elevated by an air cylinder, and said four adsorption pads are disposed at positions corresponding to those of the workpiece pockets 6 of the workpiece holder 5 when the unloading arm 11 comes just on the workpiece hoilder 5.

Figure 9:
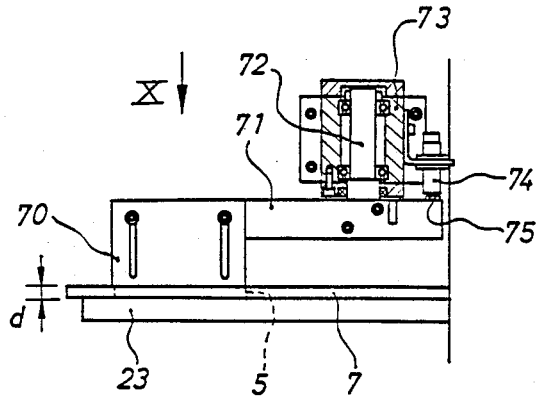
FIG. 9 is a vertical sectional view of a safety device.
Figure 10:
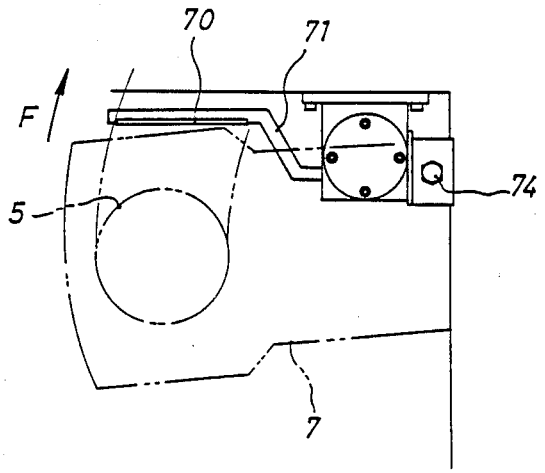
FIG. 10 is a view viewed in a direction of arrow X of FIG. 9.

FIGS. 9 and 10 show a safety device which is adapted to stop the carrier arm 7 when a too thick workpiece is loaded on the workpiece holder 5. Namely, in FIG. 9, a baffle plate 70 is fastened to the tip end portion of an arm 71 rotatably supported by a bearing case 73, and a clearance d between a lower end of the baffle plate 70 and the guide stand 23 is set to a desired allowable thickness of workpiece. A proximity switch 74 is fastened to the bearing case 73 while a bolt 75 facing on said proximity switch 74 is provided at the other end of the arm 71. In FIG. 10, the baffle plate 70 is positioned at an arrow F side in relation to the carrier arm 7 in its setting position. Namely, when a workpiece having a thickness thicker than the allowable work thickness d is loaded, said workpiece strikes against the baffle plate 70 when the carrier arm 7 turns in the direction of arrow F. Thus, the baffle plate 70 and the arm 71 turn together with the carrier arm 7 in the direction of arrow F, so that the bolt leaves the proximity switch 74. Thereby, a stopping command is sent to the air cylinder 30 of FIG. 3 to cause the carrier arm 7 to stop.

(Function of the Invention)

(1) When the workpieces W are loaded from the charging shutes 18*a* to each pocket recession 62 of the distribution holder 61 of FIG. 8, the adsorption pads 60 waiting at an upper part of the distribution holder 61 move down and adsorb the workpieces through means of the suction function as illustrated by FIG. 7.

(2) The adsorption pads 60 ascend with an upward movement of the air cylinder 54, the loading arm 10 moves to an upper part of the workpiece holder 5 caused by the turning movement of the rocking shaft 17 as illustrated by the imaginary lines of FIG. 3, and the adsorption pads 60 descend to release the suction force. Thereby, the pads charge each workpiece to each workpiece pocket 6 and they ascend again to return to the charging device 18 of FIG. 8. At the same time, the unloading arm 11 of FIG. 1 moves to an upper part of the workpiece holder 5.

(3) When the workpiece are charged to the work pockets 6, the stopper rod 45 of the air cylinder 44 of FIG. 3 is withdrawn and the workpiece holder 5 is revolved in the direction of arrow R by means of the rotation of the drive gear 28, and at the same time the carrier arm 7 is turned in the direction of arrow F by means of the pushing action of the air cylinder 30. Namely, the workpieces are transferred on the upper surface of the guide stand 23 toward the grinding wheels 2 while being revolved.

(4) The workpieces are transferred to between the grinding wheels 2 while being revolved, and the carrier arm 7 turns to the grinding position as shown by the imaginary lines. Then, the rod 32 of the air cylinder 30 is withdrawn to cause the carrier arm 7 to return in the direction of arrow B. During the rocking motion of workpieces in between the grinding wheels 2, the clearance between the upper and lower grinding wheels 2 is narrowed to a desired grinding thickness to enable the so-called cut-in grinding.

(5) When the carrier arm 7 returns to the setting position of FIG. 3 after grinding and the revolution of the workpiece holder 5 causes the commencing part P1 of the holding member 21 to pass the proximity switch 48, the revolution of the workpiece holder 5 is decelerated and the stopper rod 45 of the air cylinder 44 protrudes to contact with the outer peripheral surface of the workpiece holder 5.

(6) When the ending part P2 of the holding member 21 comes to the position of the proximity switch 48 under the decelerated revolution condition, the stopper rod 45 engaged with the notch 46 and at the same time the workpiece holder 5 stops its revolution.

(7) The adsorption pads of the unloading arm of FIG. 1 descend to adsorb the workpieces having been ground, and ascend and turn to a section of the measuring device 13. Then, they descend and release the workpieces. The workpieces are measured their ground thickness by means of the measuring device 13 and then discharged from the discharging shute 14. Further, simultaneously with the unloading process by said unloading arm 11, the loading of workpiece from the loading device to the carrier arm 7 is executed by the loading arm 10.

(Other embodiment)

The number of the workpiece pockets 6 of the workpiece holder 5 is not limitted to four, but may be two, three or more than four.

(Effect of the invention)

As described above, in this invention; the revolving workpiece holder 5 having plural workpiece pockets 6 is revolvably installed at the tip end of the carrier arm 7, the carrier arm 7 is equipped in the rockable manner within the range from the grinding position between the grinding wheels 2 to the setting position apart from the grinding wheels, the automatic limitted revolution mechanism stopping the revolution of the workpiece holder 5 at the specified angular spot in the setting position of said carrier arm 7 is equipped, the loading arm 10 and the unloading arm 11 having plural workpiece suction members in the arrangement corresponding to the workpiece pocket arrangement at the specified angular spot are equipped in the rockable manner, and the plural workpieces are simultaneously loaded on and unloaded from the workpiece holder 5 in the above setting position by means of the loading arm 10 and the unloading arm 11. Therefore, the following advantages become obtainable.

(1) The rocking carrier arm 7 enables the reciprocating supply of workpieces in between the grinding wheels and further the workpiece holder 5 enables the grinding of workpiece under the revolving condition, so that the complete cut-in grinding can be executed and the finishing accuracy can be improved as compared with the conventional so-called passing-through type carrier means.

(2) The plural workpieces are held by the workpiece holder 5 and can be ground simultaneously while being revolved, so that a working time for workpieces of one-lot can be shortened drastically while maintaining the fine finishing accuracy as mentioned above.

(3) The loading arm 10 and the unloading arm 11 having plural workpiece suction members in the arrangement corresponding to the workpiece pocket arrangement at the specified angular spot are equipped in the rockable manner, and the plural workpieces are simultaneously loaded on and unloaded from the workpiece holder 5 in the above setting position by means of the loading arm 10 and the unloading arm 11; so that automation for simultaneously loading the plural workpieces can be accomplished easily and the work efficiency of grinding work can be improved further.

What is claimed is:

1. A workpiece carrier for a surface grinding machine having spaced, opposed grinding wheels, comprising a revolving workpiece holder revolvably installed adjacent a tip end of a carrier arm for rotation on said carrier arm around the axis of said workpiece holder; a plurality of workpiece pockets passing through said workpiece holder, said pockets being equally spaced from the axis of rotation of said workpiece holder on said carrier arm and equally spaced from each other around said axis of rotation; said carrier arm being movable in a rockable manner within a range from a grinding position between said grinding wheels to a setting position spaced from said grinding wheels; an automatic limited revolution mechanism for stopping the revolution of said workpiece holder at a specified angular spot in said setting position of said carrier arm; a rockable loading arm and a rockable unloading arm each having plural workpiece holding members in an arrangement corresponding to a workpiece pocket arrangement at said specified angular spot; and plural workpieces simultaneously loaded on and unloaded from said workpiece holder in said setting position by means of said loading arm and said unloading arm, respectively.

2. A workpiece carrier means for a surface grinding machine as set forth in claim 5, in which a base end portion of said carrier arm is fastened to a rocking cylindrical shaft, a turning plate is fastened to said rocking cylindrical shaft, an air cylinder is connected to an eccentric pin of said turning plate, and a reciprocating stroke of said air cylinder causes said carrier arm to rock.

3. A workpiece carrier means for a surface grinding machine as set forth in claim 2, a rotating shaft rotatably installed within said cylindrical shaft, a lower end of said rotating shaft is coupled to a drive motor, and an upper end of said rotating shaft is connected to and interlocked with said revolving workpiece holder through a gear transmission mechanism in said carrier arm.

4. A workpiece carrier means for a surface grinding machine as set forth in any one of claim 1, claim 2 or claim 3, in which said holding members are air suction-type members.

* * * * *